US009403375B1

(12) United States Patent
Stangler et al.

(10) Patent No.: US 9,403,375 B1
(45) Date of Patent: Aug. 2, 2016

(54) CREDENTIAL PRODUCTION DEVICE TRANSFER RIBBON ACCUMULATOR

(71) Applicant: Assa Abloy AB, Stockholm (SE)

(72) Inventors: Jeffrey Stangler, Eden Prairie, MN (US); James Rieck, Brooklyn Park, MN (US); Russell Ericson, Minneapolis, MN (US)

(73) Assignee: Assa Abloy AB, Stockholm (SE)

( * ) Notice: Subject to any disclaimer, the term of this patent is extended or adjusted under 35 U.S.C. 154(b) by 0 days.

(21) Appl. No.: 14/795,265

(22) Filed: Jul. 9, 2015

(51) Int. Cl.
*B41J 33/00* (2006.01)
*B41J 2/325* (2006.01)

(52) U.S. Cl.
CPC ..... *B41J 2/325* (2013.01)

(58) Field of Classification Search
CPC ..... B41J 3/103; B41J 31/05; B41J 11/425; B41J 13/0054; B41J 35/08; B41J 35/26; B65H 2701/372; B65H 23/18
See application file for complete search history.

(56) References Cited

U.S. PATENT DOCUMENTS 6,261,012 B1 7/2001 Haas et al.
6,429,888 B1 * 8/2002 Taki ..... B41J 2/32 347/175
8,035,670 B2 * 10/2011 Shinohara ..... B41M 5/38207 347/171
8,149,255 B2 * 4/2012 Higuchi ..... B41J 2/325 347/175

* cited by examiner

*Primary Examiner* — Lamson Nguyen
(74) *Attorney, Agent, or Firm* — Brian D. Kaul; Westman, Champlin & Koehler, P.A.

(57) ABSTRACT

A credential production device includes a transfer ribbon, a printing device, a laminating device, and a transfer ribbon accumulator. The printing device is configured to print an image to the transfer ribbon. The laminating device is configured to transfer printed images from the transfer ribbon to a substrate. The transfer ribbon accumulator includes first, second, and third ribbon-engaging members (REM's), and a drive system. The first and second REM's have fixed positions relative to each other. The third REM is configured to move relative to the first and second REM's along an axis that extends through a gap between the first and second REM's. The drive system is configured to generate a force that drives movement of the third REM relative to the first and second REM's along the axis. Movement of the third REM relative to the first and second REM's along the axis changes a length of a path along which a portion of the transfer ribbon travels through the accumulator.

20 Claims, 13 Drawing Sheets

CREDENTIAL PRODUCTION DEVICE TRANSFER RIBBON ACCUMULATOR

BACKGROUND

Credentials include identification cards, driver's licenses, passports, and other documents. Such credentials are formed from credential or card substrates including paper substrates, plastic substrates, cards, and other materials. Such credentials generally include printed information, such as a photo, account numbers, identification numbers, and other personal information. Credentials can also include data that is encoded in a smartcard chip, a magnetic stripe, or a barcode, for example.

Credential production devices include processing devices that process credential substrates by performing at least one processing step in forming a final credential product. Such processes generally include a printing process, a laminating or transfer process, a data reading process, a data writing process, and/or other process used to form the desired credential.

In a transfer or reverse-image printing process, a printing device, such as a thermal or ink jet print head, is used to perform a print operation, in which an image is printed to a surface of a print intermediate. The print intermediate is commonly supported on a backing or carrier layer to form a transfer ribbon. The print intermediate is typically one of two types: a patch laminate, or a fracturable laminate or transfer layer often referred to as a "thin film laminate." The patch laminate is generally a pre-cut polyester film that has been coated with a thermal adhesive on one side. Thin film laminates or transfer layers are fracturable laminates that are generally formed of a continuous resinous material that is coated onto the polyester carrier or backing layer. The side of the resin material that is not attached to the continuous carrier layer is generally coated with a thermal adhesive which is used to create a bond between the resin and a surface of a substrate.

After the image is printed to the print intermediate, the printed image is registered with the substrate. Next, a laminating device is used to perform a lamination operation, during which the imaged print intermediate is transferred to the surface of the substrate. Typical laminating devices include a heated laminating or transfer roller that activates and presses the adhesive of the print intermediate against the surface of the substrate to bond the print intermediate to the surface. The carrier or backing layer is then removed to complete the transfer printing process leaving the imaged print intermediate attached to the substrate.

During conventional print and transfer operations in a credential production device, it is necessary to move the transfer ribbon relative to the printing device and the laminating device, respectively. This requires transfer and print operations to be performed in series. That is, a print operation cannot be performed during a transfer operation, and a transfer operation cannot be performed during a print operation. This limits the speed at which the printer can complete the transfer printing processes.

SUMMARY OF ILLUSTRATIVE EMBODIMENTS

Some embodiments of the invention are directed to a credential production device that is configured to perform a transfer of printing process on a substrate to form a credential product. In some embodiments, the device includes a transfer ribbon, a printing device, a laminating device, and a transfer ribbon accumulator. The printing device is configured to print an image to the transfer ribbon. The laminating device is configured to transfer printed images from the transfer ribbon to a substrate. The transfer ribbon accumulator includes first, second, and third ribbon-engaging members (REM's), and a drive system. The first and second REM's have fixed positions relative to each other and are separated by a gap. The third REM is configured to move relative to the first and second REM's along an axis that extends through the gap. The drive system is configured to generate a force that drives movement of the third REM relative to the first and second REM's along the axis. Movement of the third REM relative to the first and second REM's along the axis changes a length of a path along which a portion of the transfer ribbon travels through the accumulator.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
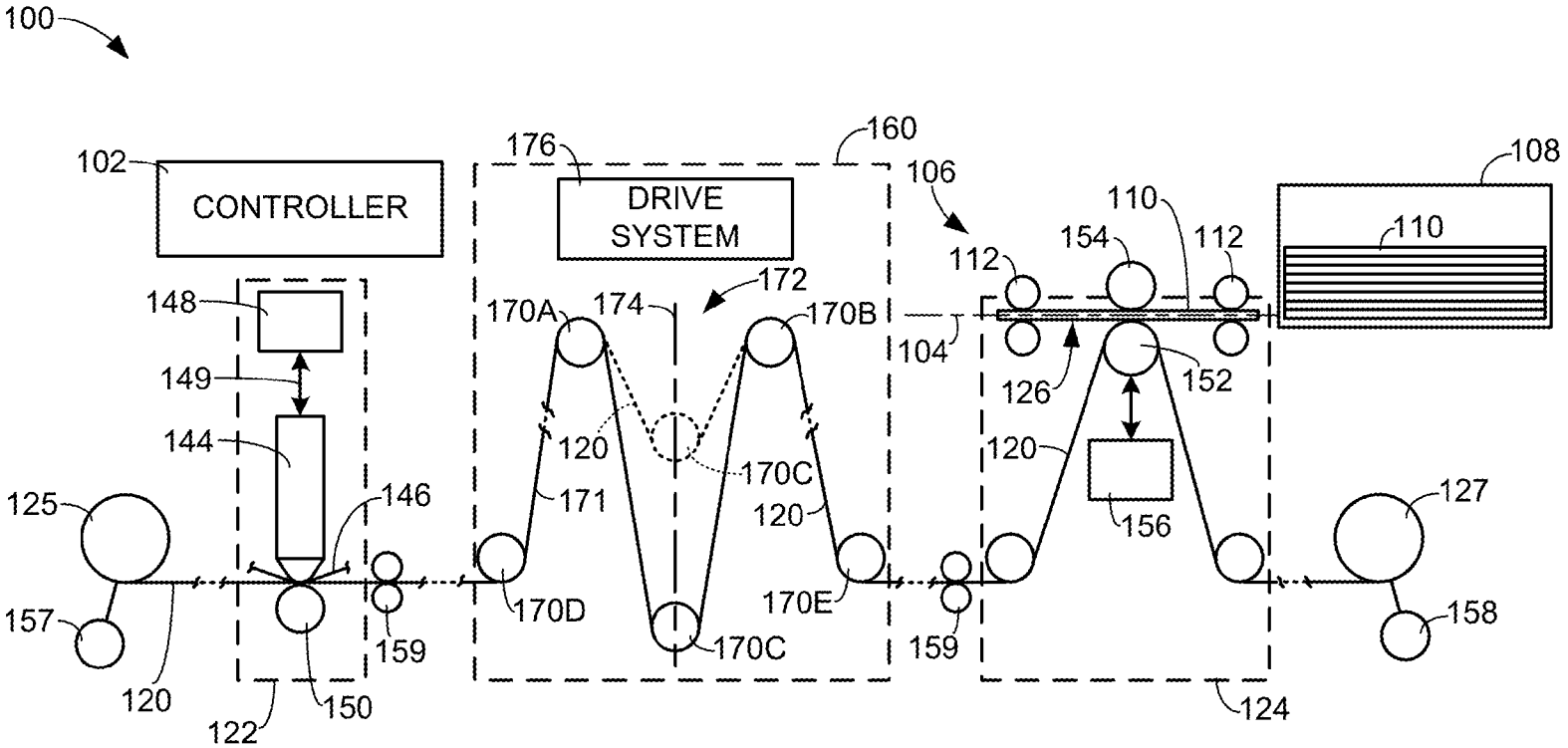
FIG. 1 is a simplified block diagram of an exemplary credential production device in accordance with embodiments of the invention.

Embodiments of the invention are described more fully hereinafter with reference to the accompanying drawings. Elements that are identified using the same or similar reference characters refer to the same or similar elements. Some elements may be referred generally by a reference number and more specifically by the reference number followed by a letter and/or other reference character. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art.

Specific details are given in the following description to provide a thorough understanding of the embodiments. However, it is understood by those of ordinary skill in the art that the embodiments may be practiced without these specific details. For example, circuits, systems, networks, processes, frames, supports, connectors, motors, processors, and other components may not be shown, or shown in block diagram form in order to not obscure the embodiments in unnecessary detail.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "connected" or "coupled" to another element, it can be directly connected or coupled to the other element or intervening elements may be present. In contrast, if an element is referred to as being "directly connected" or "directly coupled" to another element, there are no intervening elements present.

It will be understood that, although the terms first, second, etc. may be used herein to describe various elements, these elements should not be limited by these terms. These terms are only used to distinguish one element from another. Thus, a first element could be termed a second element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As will further be appreciated by one of skill in the art, the present invention may be embodied as methods, systems, devices, and/or computer program products, for example. The computer program or software aspect of the present invention may comprise computer readable instructions or code stored in a computer readable medium or memory. Execution of the program instructions by one or more processors (e.g., central processing unit) results in the one or more processors performing one or more functions or method steps described herein. Any suitable patent subject matter eligible computer readable media or memory may be utilized including, for example, hard disks, CD-ROMs, optical storage devices, or magnetic storage devices. Such computer readable media or memory do not include transitory waves or signals.

The computer-usable or computer-readable medium may be, for example, but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

FIG. 1 is a simplified block diagram of an exemplary credential production device 100 in accordance with embodiments of the invention. In some embodiments, the device 100 includes a controller 102 representing one or more processors that are configured to execute program instructions stored in memory of the device or other location. The execution of the instructions by the controller 102 controls components of the device 100 to perform functions and method steps described herein.

In some embodiments, the device 100 includes a processing path 104, a transport mechanism 106, and a substrate supply 108. The substrate supply 108 may be in the form of a container or cartridge that is configured to contain individual substrates 110. The substrates 110 are individually fed from the supply 108 along the processing path 104, which is parallel to the processing path 104, for processing using the transport mechanism 106, which is controlled by the controller 102. In some embodiments, the transport mechanism 106 includes one or more motorized feed rollers or feed roller pairs 112, or other suitable mechanism. Sensors may be used to assist the controller 102 in the feeding of the substrates 110 along the processing path 104, and aligning the substrates 110 with substrate processing devices along the processing path 104.

The substrates 110 may take on many different forms, as understood by those skilled in the art. In some embodiments, the substrate 110 is a credential substrate. As used herein, the term "credential substrate" includes substrates used to form credentials, such as identification cards, membership cards, proximity cards, driver's licenses, passports, credit and debit cards, and other credentials or similar products. Exemplary card substrates include paper substrates other than traditional paper sheets used in copiers or paper sheet printers, plastic substrates, rigid and semi-rigid card substrates, and other similar substrates.

In some embodiments, the device 100 is configured to perform a transfer printing process or reverse-image printing process to print an image to the substrate 110. In some embodiments, the device includes a transfer ribbon 120, a printing device 122 and a laminating device 124. The printing device 122 is configured to print an image to a print intermediate of the transfer ribbon 120. The laminating device 124 is configured to transfer printed images from the print intermediate of the transfer ribbon 120 to a surface 126 of the substrate 110.

In some embodiments, the transfer ribbon 120 is wound between a supply spool 125 and a take-up spool 127, and extends through the printing device 122 and the laminating device 124, as shown in FIG. 1. The transfer ribbon 120 is configured to receive images that are printed using the printing device 122 and transfer the printed images to the surface 126 of the substrate 110 using the laminating device 124.

Figure 2:
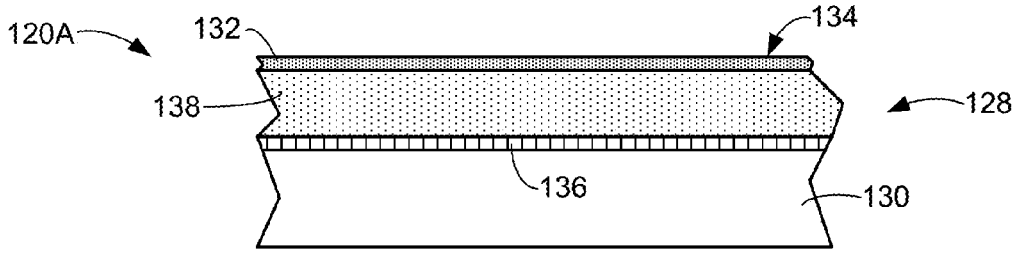
FIG. 2 is a simplified cross-sectional view of a portion of an exemplary transfer ribbon that includes a print intermediate in the form of a transfer layer, in accordance with embodiments of the invention.

FIG. 2 is a simplified side cross-sectional view of an exemplary transfer ribbon 120A having a print intermediate in the form of a transfer layer 128, in accordance with embodiments of the invention. In some embodiments, the transfer layer 128 is attached to a backing or carrier layer 130. In some embodiments, the transfer layer 128 is in the form of a fracturable laminate or thin film laminate. In some embodiments, the transfer layer 128 includes a thermal adhesive 132, which is activated during a transfer lamination process using the laminating device 124 to bond a section of the transfer layer 128 to the surface 126 of the substrate 110. In some embodiments, the transfer layer 128 includes an image receptive surface 134 on the thermal adhesive 132 that is configured to receive an image that is printed using the printing device 122 during a print operation. The transfer ribbon 120A may also include a release layer 136 between the transfer layer 128 and the carrier layer 130 that assists in releasing the transfer layer 128 from the carrier layer 130 during a transfer lamination process.

In some embodiments, the transfer layer 128 includes a protective layer 138 located between the adhesive layer 132 and the carrier layer 130. Alternatively, the protective layer 138 may be combined with the adhesive layer 132. The protective layer 138 operates to provide protection to the surface 126 of the substrate 110 to which the transfer layer 128 is laminated. The protective layer 138 may also protect an image printed on the image receptive surface 134 when the transfer layer 128 is laminated to a surface 126 of a substrate 110. Other conventional materials or layers may also be included in the transfer ribbon 120A and the transfer layer 128.

Figure 3:
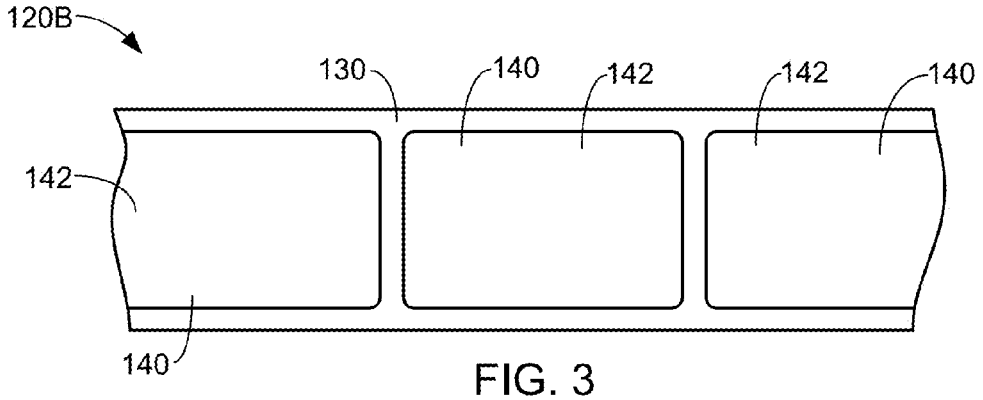
FIG. 3 is a simplified top view of a portion of an exemplary transfer ribbon that includes print intermediates in the form of overlaminate patches, in accordance with embodiments of the invention.

FIG. 3 is a simplified top view of an exemplary transfer ribbon 120B having print intermediates in the form of overlaminate patches 140, in accordance with embodiments of the invention. The overlaminate patches 140 are attached to a backing or carrier layer 130. Each overlaminate patch 140 includes an exposed surface 142 having a layer of thermal adhesive, which is activated by the laminating device during a transfer lamination operation to bond the patch 140 to the surface 126 of a substrate. Each overlaminate patch 140 is formed of a polyester film or other suitable material that provides protection to the surface 126 of the substrate 110. In some embodiments, the surface 142 includes an image receptive material that is adapted to receive an image printed using the printing device 122. Other conventional materials or layers may also be included in the transfer ribbon 120B and the patches 140.

The printing device 122 is configured to print an image to the transfer ribbon 120 and, more specifically, to a print intermediate of the transfer ribbon 120, such as the transfer layer 128 of the transfer ribbon 120A (FIG. 2) or the patch 140 of the transfer ribbon 120B (FIG. 3). In some embodiments, the printing device 122 includes a print head 144. In some embodiments, the print head 144 is a conventional thermal print head and the printing device 122 includes a thermal print ribbon 146, as shown in FIG. 1. In some embodiments, the thermal print head 144 includes a plurality of heating elements that heat the print ribbon 146 and cause dye, resin, and/or other print materials to transfer to the print intermediate of the transfer ribbon 120 to form the desired image on the print intermediate, in accordance with conventional techniques.

In some embodiments, the print head 144 is an ink jet print head 144, which applies ink to the print intermediate of the transfer ribbon 120 to produce a desired image on the print intermediate. In this case, the print ribbon 146 is not used.

In some embodiments, the printing device 122 includes a print head lift mechanism 148 that is configured to move the print head 144 relative to the transfer ribbon 120, as indicated by arrow 149. In some exemplary embodiments, the lift mechanism 148 moves the print head 144 between a retracted position (not shown), in which the print head 144 is disengaged from the transfer ribbon 120, and a print position, in which the print head 144 presses the print ribbon 146 against the transfer ribbon 120 under the support of support member 150, such as a platen roller or other suitable support member, as shown in FIG. 1.

The laminating device 124 is configured to perform a transfer or lamination operation, during which an imaged print intermediate is transferred from the transfer ribbon 120 to the surface 126 of the substrate 110. Some embodiments of the laminating device 124 include a laminating or transfer roller 152 that is configured to heat the print intermediate supported by the transfer ribbon 120 and press the print intermediate against the surface 126 of the substrate 110. This heating activates the thermal adhesive of the print intermediate causing the print intermediate to bond to the surface 126 of the substrate 110. In some embodiments, the laminating device 124 includes a platen roller 154 that provides support for the substrate 110 during the lamination operation.

In some embodiments, the laminating device 124 includes a lift mechanism 156 that is configured to move the transfer roller 152 relative to the processing path 104. In some embodiments, the lift mechanism 156 is configured to move the transfer roller 152 between a retracted position (not shown), in which the transfer roller 152 is displaced from the processing path 104 and a substrate 110 in the processing path, and a laminating position, in which the transfer roller 152 presses the transfer ribbon 120 against the surface 126 of a substrate 110 supported in the processing path 104 by the platen roller 154, as shown in FIG. 1.

In some embodiments, the device 100 includes transfer ribbon feeding components that are configured to feed the transfer ribbon 120 through the printing device 122 and through the laminating device 124. The transfer ribbon feeding components can take on many different forms. In some embodiments, the transfer ribbon feeding components include a motor 157 that is configured to drive rotation of the supply spool 125, and/or a motor 158 is configured to drive rotation of the take-up spool 127, as shown in FIG. 1. In some embodiments, the transfer ribbon feeding components include motorized feed rollers or other components that can control the feeding of the transfer ribbon 120 through the printing device 122 and the laminating device 124, such as feed rollers 159, the platen roller 150, and/or the platen roller 154, for example. The transfer ribbon feeding components are controlled by the controller 102 and allow for independent feeding of the transfer ribbon 120 through the printing device 122 and the laminating device 124. Thus, during a print operation, the controller 102 controls the feeding of the transfer ribbon 120 through the printing device 122 using one or more of the transfer ribbon feeding components to facilitate the performance of a print operation using the print head 144 to print an image to the transfer ribbon 120.

Similarly, the controller 102 controls the feeding of the transfer ribbon 120 through the laminating device 124 during a lamination operation using one or more of the transfer ribbon feeding components to transfer a printed image from the transfer ribbon 120 to the surface 126 of the substrate 110. This allows the device 100 to perform printing and lamination operations independently from each other. As a result, the printing device 122 and the laminating device 124 can simultaneously perform print and lamination operations, respectively. As a result, the device 100 is capable of performing transfer printing operations more efficiently than transfer printing operations performed by conventional credential production devices.

In some embodiments, the device 100 includes a transfer ribbon accumulator 160, which is configured to take-up or reduce slack in the transfer ribbon 120 that is generated in response to the independent feeding of the transfer ribbon 120 by the devices 122 and 124 during print and lamination operations. In some embodiments, the transfer ribbon accumulator 160 includes multiple ribbon-engaging members (REM's), which are generally referred to as 170. In some embodiments, the REM's 170 are rollers having an axis of rotation that is generally perpendicular to the axis 174, a bar, a guide member, or other suitable component.

In some embodiments, the accumulator 160 includes at least REM's 170A-C, as shown in FIG. 1. In some embodiments, a section 171 of the transfer ribbon 120 extends from the printing device 122 to the laminating device 124, and the REM's 170A-C engage a portion of the section 171 of the transfer ribbon, as shown in FIG. 1. In some embodiments, REM's 170A and 170B have fixed positions relative to each other and are separated by a gap 172. The REM 170C is configured to move relative to the REM's 170A and 170B along an axis 174 that extends through the gap 172. The length of the path the transfer ribbon 120 travels through the accumulator 160 can be adjusted by adjusting the relative positions of the REM's 170A and 170B and the REM 170C.

The maximum length of the transfer ribbon 120 that is accommodated by the accumulator may be increased by increasing the distance that the REM 170C may be displaced from the REM's 170A and 170B, and/or by adding additional REM's 170. In some embodiments the accumulator 160 includes at least REM's 170A-C, and may include additional REM's 170, such as exemplary REM's 170D and 170E shown in FIG. 1, as necessary to accommodate the desired length of the transfer ribbon 120 in the accumulator 160, for example. In some embodiments, the REM's 170D and 170E have a fixed position relative to the REM's 170A and 170B. That is, REM's 170D and 170E move with movement of the REM's 170A and 170B. In some embodiments, the REM's 170D and 170E have a fixed position relative to the REM 170C and, therefore, move with movement of the REM 170C.

In some embodiments, the accumulator 160 includes a drive system 176 that is configured to apply a force that drives movement of at least REM 170C, relative to the REM's 170A and 170B along the axis 174, as indicated in phantom lines in FIG. 1. In some embodiments, the drive system 176 applies the force to the REM's 170A and 170B. In some embodiments, the drive system 176 applies the force to the REM 170C.

The force applied by the drive system 176 maintains a desired tension in the transfer ribbon 120 during print and/or lamination operations. The displacement between at least the REM 170C and the REM's 170A and 170B in response to the force applied by the drive system 176 is adjusted automatically to either increase or decrease the length of the path the transfer ribbon 120 is routed through the accumulator 160. This allows the accumulator 160 to accommodate different rates at which the accumulator 160 receives and discharges the transfer ribbon 120.

When the rate at which the transfer ribbon 120 is fed into the accumulator is greater than the rate at which the transfer ribbon 120 is fed out of the accumulator 160, the tension applied by the drive system 176 causes an increase in the displacement between the REM 170C and the REM's 170A and 170B along the axis 174, which increases the length of the path the transfer ribbon 120 travels through the accumulator. This increase in the path of the transfer ribbon 120 through the accumulator 160 allows the accumulator to increase the length of the transfer ribbon 120 that it accommodates to take up slack that would otherwise form in the transfer ribbon 120.

When the rate at which the transfer ribbon 120 is fed into the accumulator is less than the rate at which the transfer ribbon 120 is fed out of the accumulator 160, the force applied by the drive system 176 is overcome by an increase in tension in the transfer ribbon 120. This causes a decrease in the displacement between the REM 170C and the REM's 170A and 170B along the axis 174, which decreases the length of the path the transfer ribbon 120 travels through the accumulator. This decrease in the path of the transfer ribbon 120 through the accumulator 160 accommodates the discharge of the transfer ribbon 120 at a greater rate than the rate at which the transfer ribbon 120 is fed into the accumulator 160.

Figure 4:
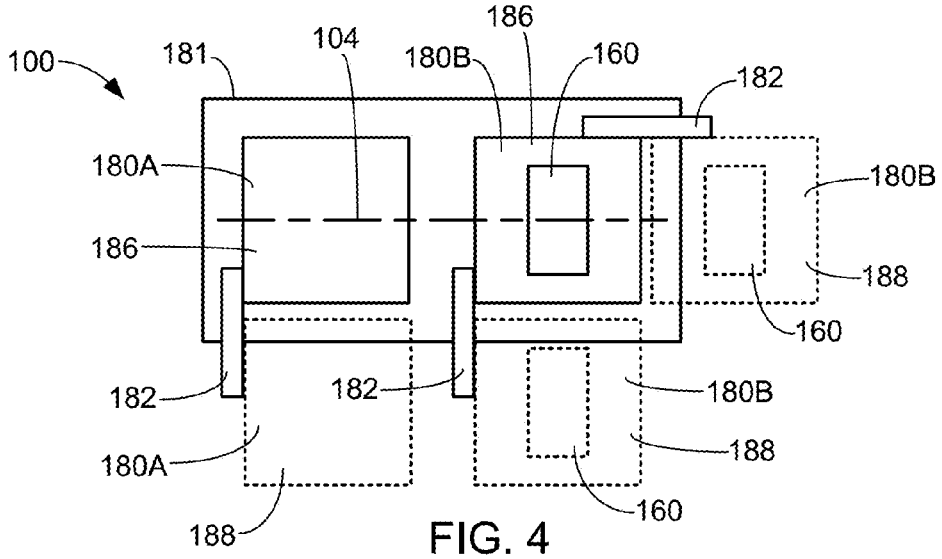
FIG. 4 is a simplified top view of a credential production device in accordance with embodiments of the invention.

FIG. 4 is a simplified top view of a credential production device 100 in accordance with embodiments of the invention. In some embodiments, the device 100 includes one or more processing assemblies, generally referred to as 180. In some embodiments, the one or more processing assemblies 180 include an assembly 180A and/or an assembly 180B. While one or more embodiments described herein may refer to both processing assemblies 180A and 180B, it is understood that such embodiments may apply to only a single processing assembly 180 of the device 100.

In some embodiments, each of the processing assemblies 180 are configured to move relative to the main frame 181 and the processing axis 104 between an operating position (solid lines) and a loading position (phantom lines). In some embodiments, the main frame 181 is a portion of the device 100 that supports and/or houses the majority of the components of the device 100, comprises the base of the device, and/or generally sits in a fixed position relative to the surface upon which the device 100 is placed. In some embodiments, the processing assemblies 180 also move relative to the processing axis 104 between their operating and loading positions, as shown in FIG. 4.

In some embodiments, one or more of the processing assemblies 180A are configured to move relative to the main frame 181 in a direction that is perpendicular to the processing axis 104, as indicated by the processing assemblies 180A and 180B shown in phantom lines in FIG. 4. In some embodiments, at least one of the processing assemblies 180 is configured to move relative to the main frame 181 in a direction that is parallel to the processing axis 104, as indicated by the processing assembly 180B shown in phantom lines in FIG. 4.

In some embodiments, the movement of the processing assemblies 180 between their operating and loading positions is facilitated by at least one guide member 182. In some embodiments, the guide members 182 facilitate linear movement of the processing assemblies 180 between their loading and operating positions. In some embodiments, each of the guide members 182 have a portion that is attached to the main frame 181 and a portion that is attached to the corresponding processing assembly 180, such as a frame of the processing assembly 180.

In some embodiments, the processing assemblies 180 include or support at least one processing device, such as the printing device 122 or the laminating device 124, for example, or components thereof. When the processing assemblies 180 are in the operating position, their respective processing devices are configured to perform a process on the transfer ribbon 120 and/or the substrate 110. For instance, when the processing assembly 180A includes the printing device 122, the printing device 122 is only configured to print an image to the transfer ribbon 120 when the processing assembly 180A is in the operating position. Similarly, when the processing assembly 180B includes the laminating device 124, the laminating device 124 is configured to transfer an image from the transfer ribbon 120 to the surface 126 of the substrate 110 only when the processing assembly 180B is in its operating position. In some embodiments, movement of the processing assemblies 180 to their loading positions allows for the loading of a consumable supply into the processing assembly 180, and/or access to the processing device of the processing assembly 180. For example, in some embodiments, the loading position of the processing assembly 180 facilitates the loading and unloading of the transfer ribbon 120 into the processing assembly 180, or the loading or unloading of the print ribbon 146 into the processing assembly 180.

In some embodiments, at least one of the processing assemblies 180 includes or supports the accumulator 160, or a portion of the accumulator 160. That is, the accumulator 160 or a portion thereof, moves relative to the main frame 181 with movement of the processing assembly 180 supporting it. Thus, the assembly 180B may provide support for the entire accumulator 160, such as support for the REM's 170A-C, or the processing assembly 180B may support only a portion of the accumulator 160, such as the REM's 170A and 170B, or the REM 170C, for example. In some embodiments, the portions of the accumulator 160 that are not supported by one of the processing assemblies 180 are supported by the main frame 181, and do not move relative to the main frame with movement of the processing assembly. Rather, in some embodiments, the portions of the accumulator 160 that are not supported by the processing assemblies 180 have a fixed position relative to the main frame.

Figure 5:
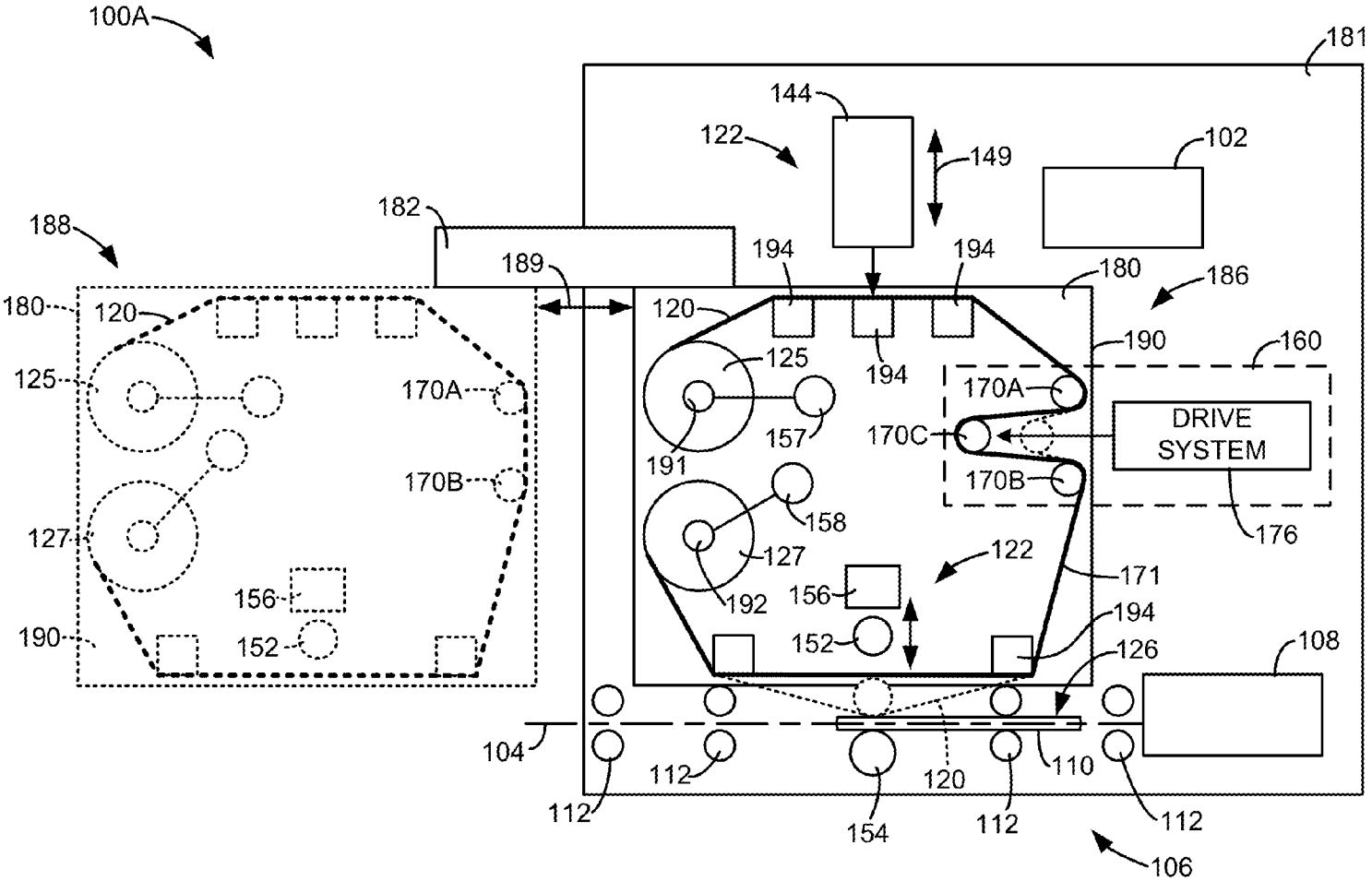
FIG. 5 is a simplified diagram of an exemplary credential production device in accordance with embodiments of the invention.

FIG. 5 is a simplified diagram of an exemplary credential production device 100A in accordance with embodiments of the invention. In some embodiments, the device 100A includes a processing assembly 180 that is movable along an axis 189 that is parallel to the processing axis 104 to move the processing assembly 180 relative to the main frame 181 between an operating position (solid lines) 186 to a loading position (phantom lines) 188. In some embodiments, the processing assembly 180 includes or supports one or more components of the laminating device 124, and is configured to perform a lamination operation on a substrate 110 that is fed along the processing axis 104 when the processing assembly 180 is in the operating position 186, as indicated in FIG. 5. It is understood that, in alternative embodiments, the processing assembly 180 may also include or support one or more components of the printing device 122, and is configured to perform a print operation on the transfer ribbon 120 when in the operating position 186. As used herein, the term "supports" means that the components are attached to a frame 190 of the processing assembly that moves relative to the main frame 181 as the processing assembly 180 moves between the operating and loading positions 186 and 188.

Figure 6:
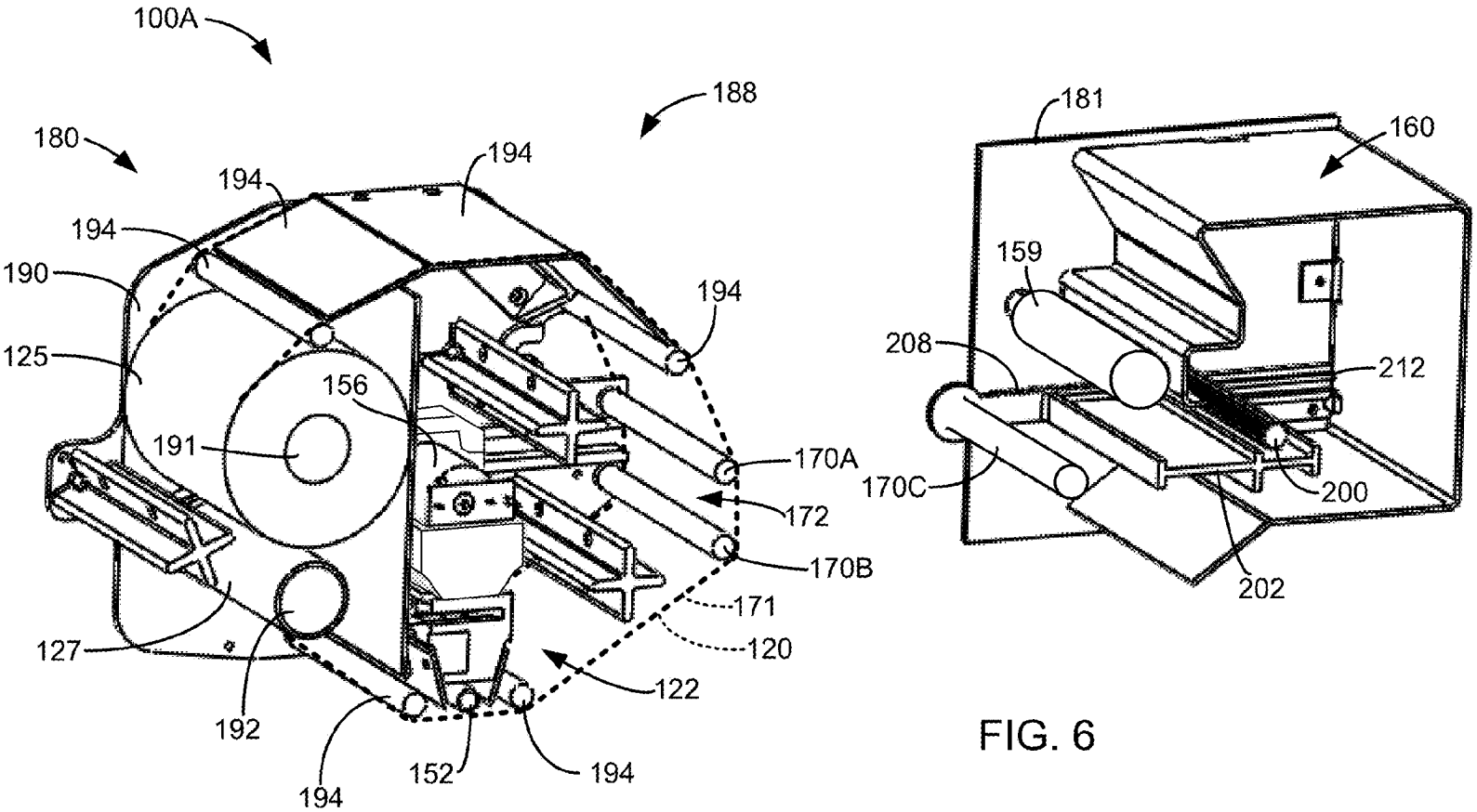
FIG. 6 is an isometric view of an exemplary processing assembly in a loading position, in accordance with embodiments of the invention.
Figure 7:
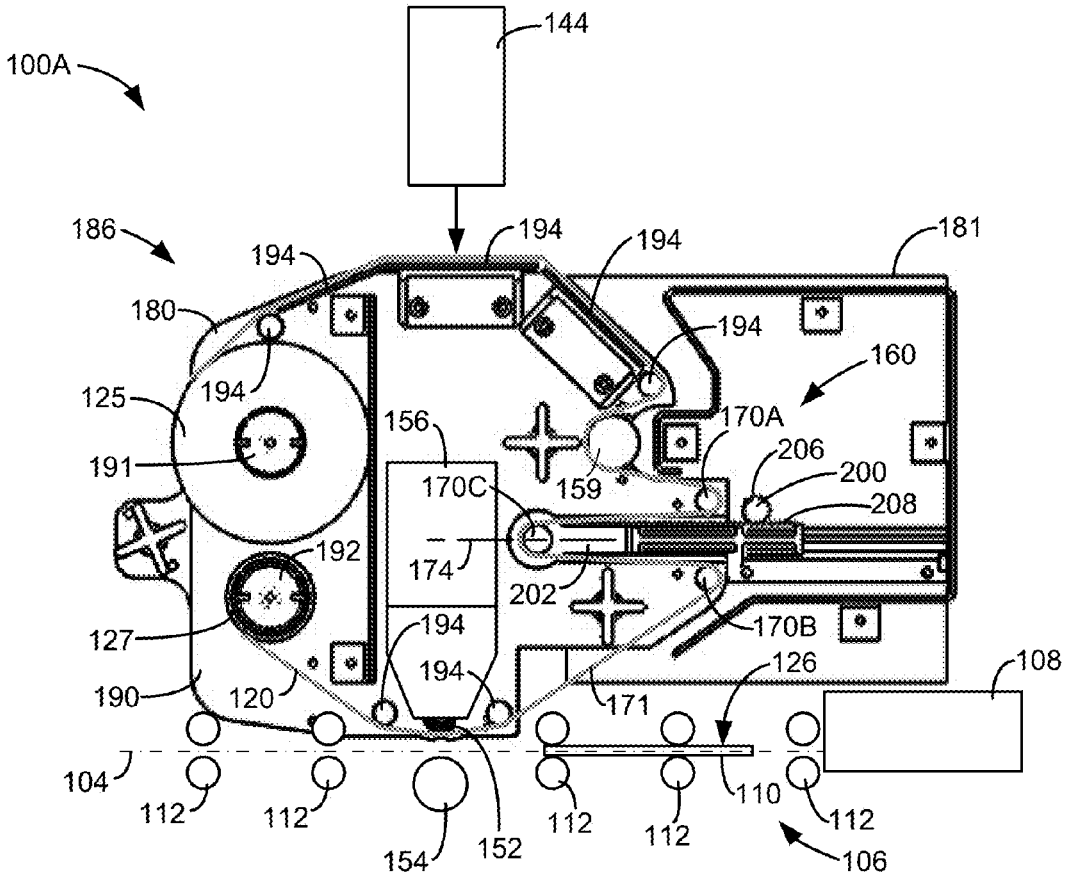
FIG. 7 is a side cross-sectional view of a portion of a credential production device with the exemplary processing assembly of FIG. 6 in an operating position, in accordance with embodiments of the invention.
Figure 8:
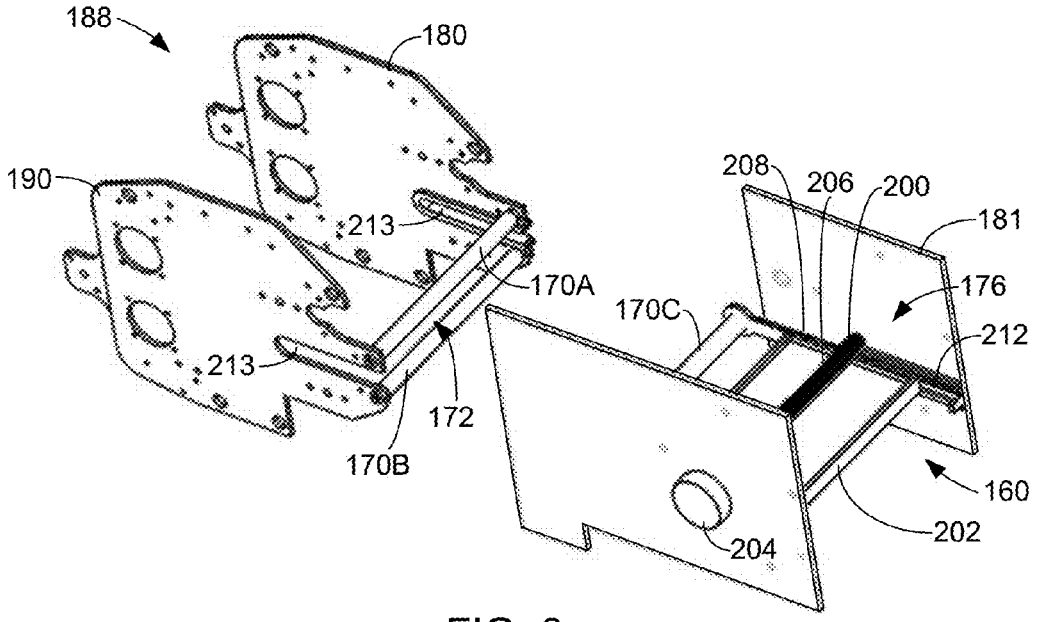
FIGS. 8 and 9 are isometric views illustrating the support of components of an accumulator, in accordance with embodiments of the invention.
Figure 9:
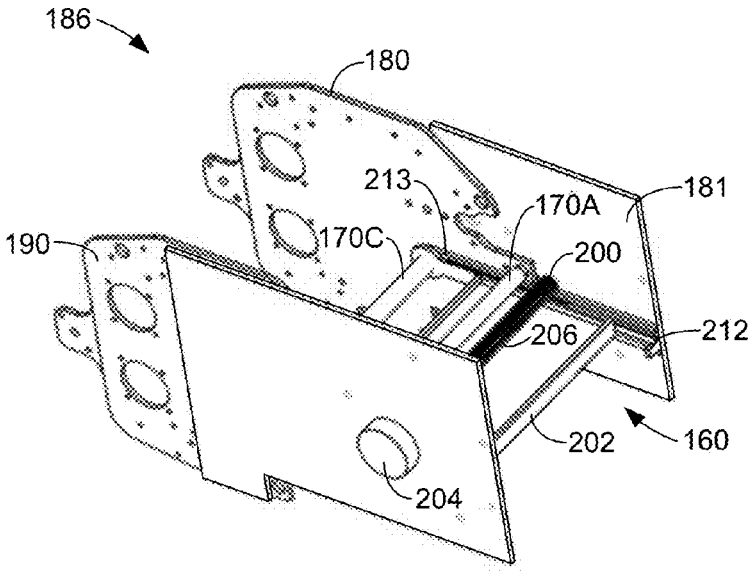
Figure 10:
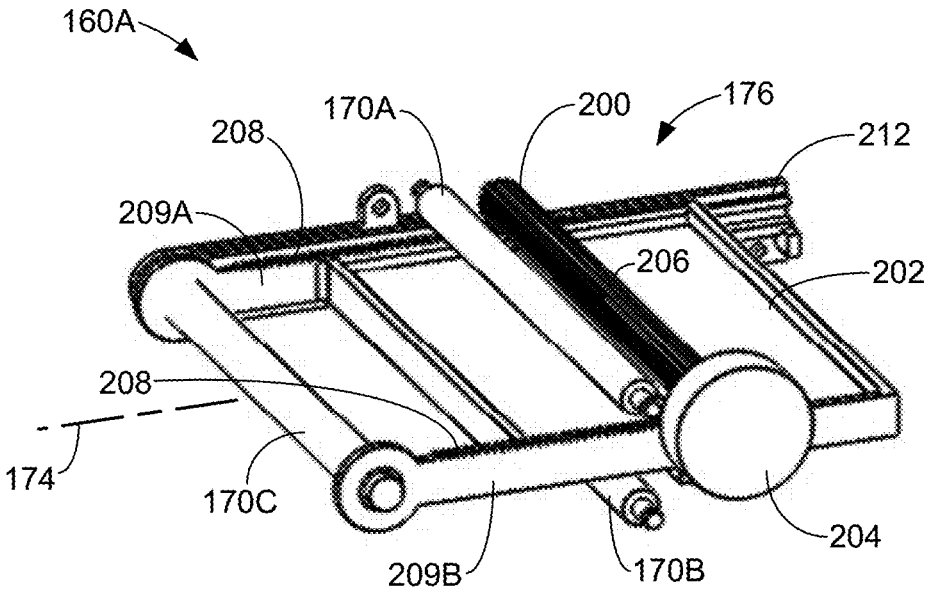
FIG. 10 is an isometric view of components of an accumulator in accordance with exemplary embodiments of the invention.

Additional embodiments of the device 100A will be described with reference to FIGS. 6-10. FIG. 6 is isometric view of the exemplary processing assembly 180 in the loading position 188, in accordance with embodiments of the invention. FIG. 7 is a side cross-sectional view of a portion of the credential production device 100A with the exemplary processing assembly 180 in the operating position 186, in accordance with embodiments of the invention. FIGS. 8 and 9 are isometric views illustrating the support of components of the accumulator 160 by the processing assembly frame 190 and the main frame 181 when the processing assembly 180 is respectively in the loading position 188 and the operating position 186, in accordance with embodiments of the invention. FIG. 10 is an isometric view of components of an accumulator 160 in accordance with exemplary embodiments of the invention.

In some embodiments, the processing assembly 180 includes a supply spool support 191, which supports the supply spool 125 and is driven by the motor 157, and a take-up spool support 192 that supports the take-up spool 127 and is driven by the motor 158, as shown in FIGS. 5-7. In some exemplary embodiments, the processing assembly 180 includes a plurality of ribbon supports 194 that support the transfer ribbon 120 on the processing assembly 180. The ribbon supports 194 may be in the form of rollers, bars, plates or other suitable ribbon supports as illustrated in FIGS. 6-7. When the processing assembly 180 is in the loading position 188, a user may conveniently remove and replace the transfer ribbon 120 on the supply spool support 191, the take-up spool support 192 and the ribbon supports 194.

In some embodiments, the processing assembly 180 supports at least a portion of the accumulator 160, as shown in FIGS. 6 and 8. While the accumulator 160 is depicted as including three REM's 170, it is understood that the accumulator 160 may include additional REM's 170, as described above.

In some embodiments, the drive system 176 includes at least one pinion 200, a rack 202, and a drive force mechanism 204 that drives rotation of the pinion 200, as best shown in FIG. 10. In some embodiments, the pinion 200 includes external gears 206 that intermesh with gears 208 of the rack 202, such as the gears 208 on the rails 209A and 209B. In some embodiments, the rack 202 is configured to move linearly along the axis 174 in response to rotation of the pinion 200. In some embodiments, opposing sides of the rack 202 are each supported by a guide 212 for movement along the axis 174 in response to rotation of the pinion 200. In some embodiments the REM 170C is attached to the rack 202 and moves along the axis 174 with movement of the rack 202. In some embodiments, the REM 170C is supported in slots 213 of the processing assembly frame 190 during movement of the REM 170C along the axis 174, as shown in FIGS. 8 and 9.

In some embodiments, the force generated by the drive force mechanism 204 is substantially continuous. In some embodiments, the drive force mechanism 204 comprises a spring mechanism, such as a power spring, a constant force spring, or other suitable spring mechanism. In some embodiments, the drive force mechanism 204 includes an electric motor.

In some embodiments, the REM 170C, the pinion 200, the rack 202, and the drive force mechanism 204 are each supported by the main frame 181 of the credential production device 100A, while the REM's 170A and 170B are supported by the processing assembly frame 190, as shown in FIGS. 5-9. As a result, the REM's 170A and 170B move with the processing assembly 180 from the operating position 186 to the loading position 188, while the drive system 176 and the REM 170C remain attached to the main frame 181, as shown in FIG. 5. It is understood that this arrangement of components of the accumulator 160 may be reversed such that the REM's 170A and 170B are supported by the main frame 181, while the REM 170C and the drive system 176 are supported by the processing assembly frame 190 and move relative to the main frame 181 with movement of the processing assembly 180 between the operating position 186 and the loading position 188.

The transfer ribbon 120 may be installed on the processing assembly 180 while the processing assembly 180 is in the loading position 188. This may involve the installation of the supply and take-up spools 125 and 127 on the corresponding supports 191 and 192, and extending the transfer ribbon 120 over the ribbon supports 194 and the REM's 170A and 170B, as shown in FIG. 6. Once the transfer ribbon 120 is loaded on the processing assembly 180, the processing assembly 180 may be moved by hand to the operating position 186 using the guide 182, for example. This movement along the axis 189 causes the REM 170C to engage the transfer ribbon 120 and drive the transfer ribbon 120 between the REM's 170A and 170B along the axis 174, as shown in FIGS. 5 and 7. The force applied by the drive system 176 to the REM 170C maintains the desired tension in the transfer ribbon 120 and allows the transfer ribbon 120 to enter the accumulator 160 and exit the accumulator 160 at different rates, as described above. This allows the printing device 122 to perform a print operation on the transfer ribbon 120, while the laminating device 124 performs a lamination operation to transfer an image to the surface 126 of the substrate 110, as indicated in FIG. 5.

Figure 11:
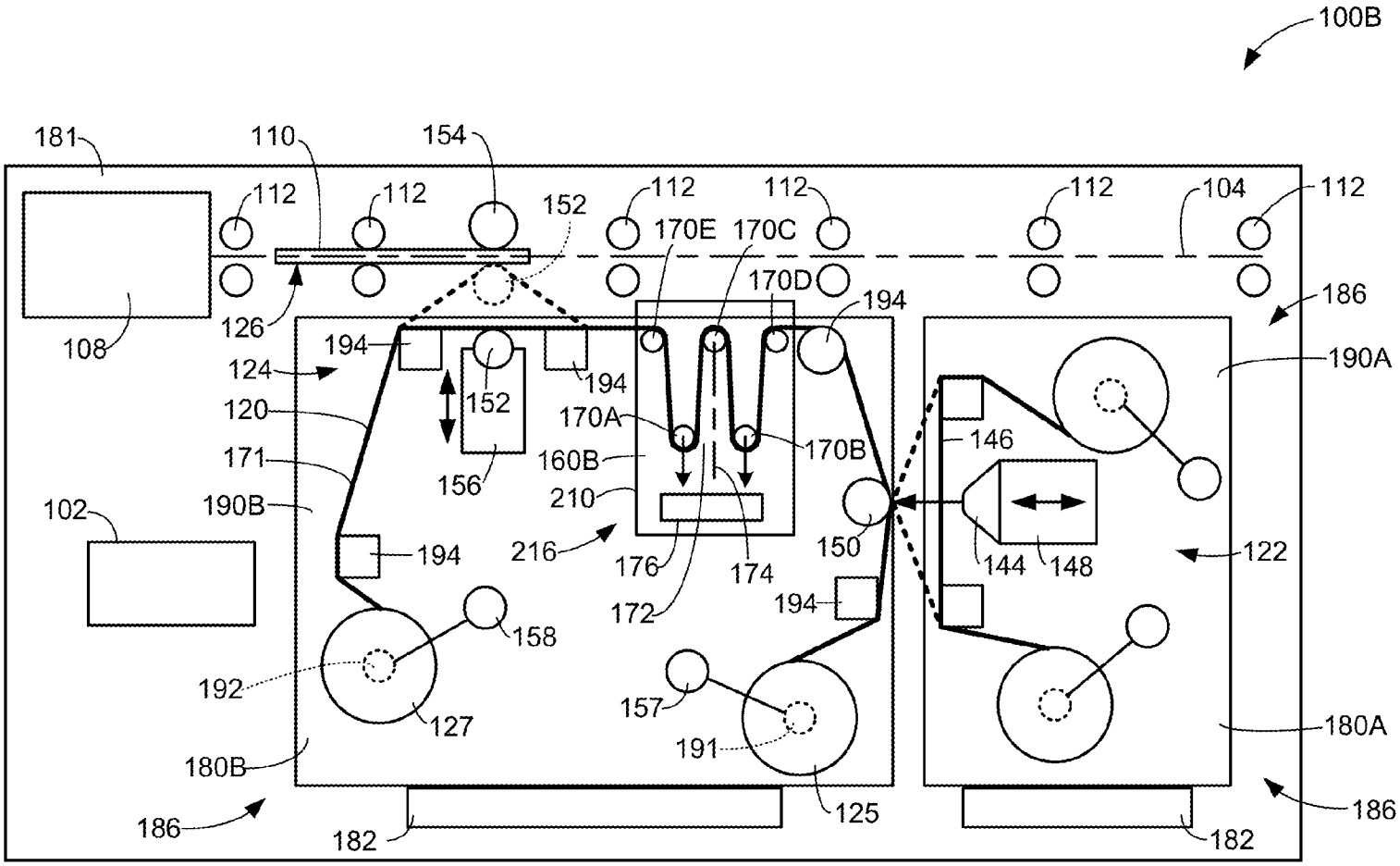
FIG. 11 is a simplified side view of an exemplary credential production device in accordance with embodiments of the invention.
Figure 12:
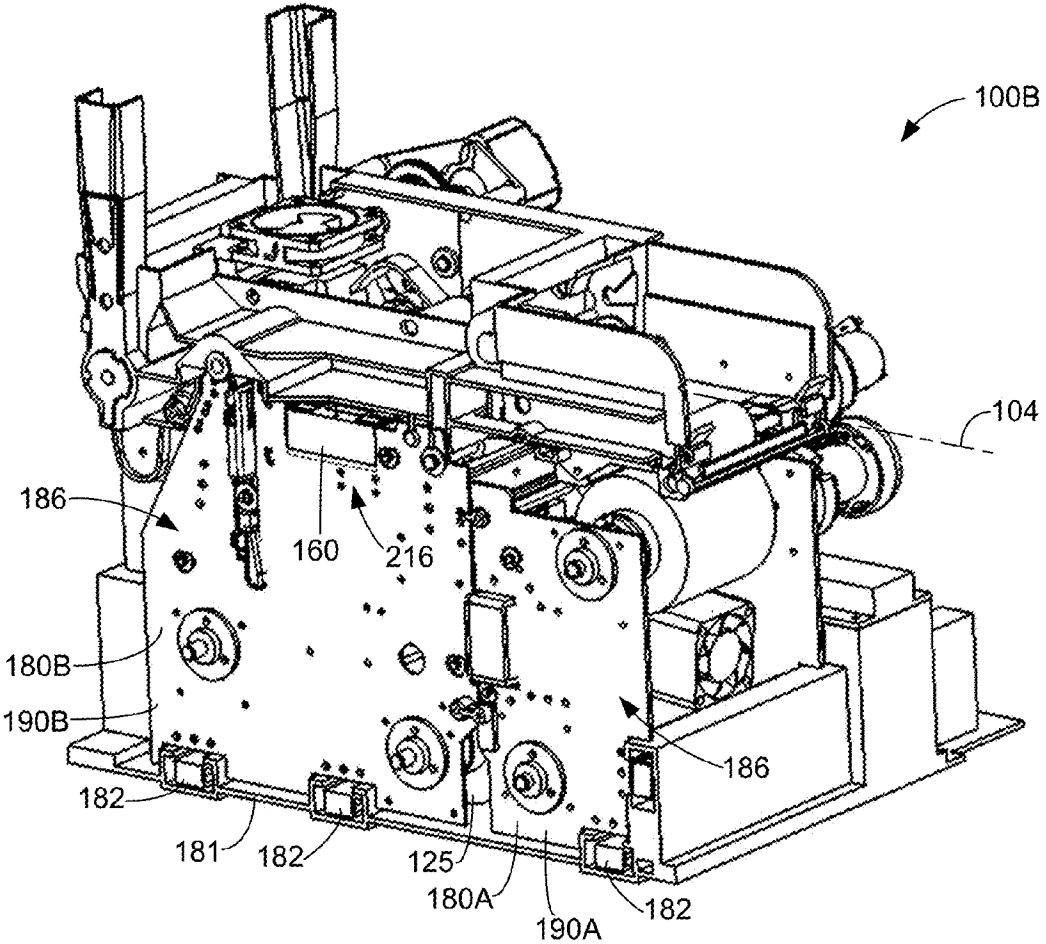
FIG. 12 is an isometric view of the device of FIG. 11 having exemplary processing assemblies in operating positions, in accordance with embodiments of the invention.
Figure 13:
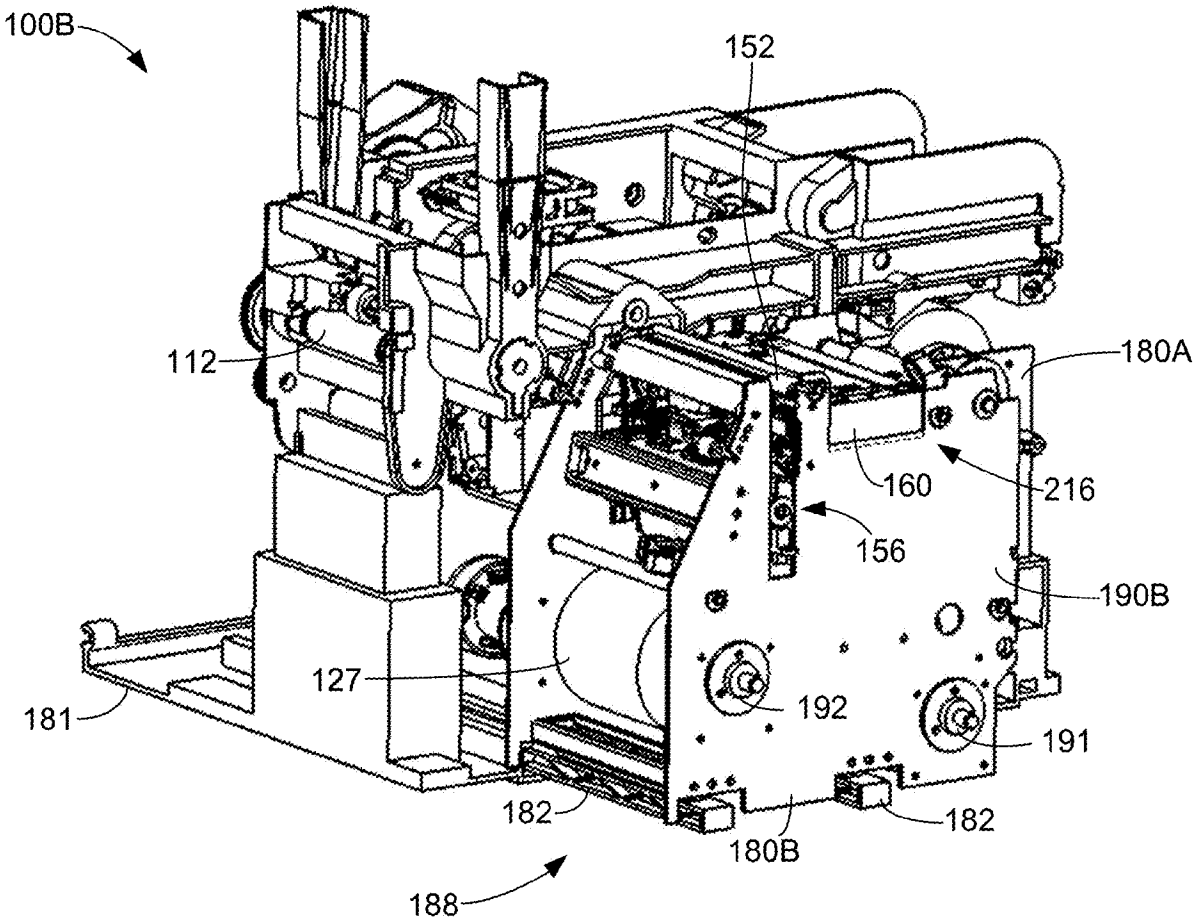
FIG. 13 is an isometric view of the device with a processing assembly in a loading position, in accordance with embodiments of the invention.
Figure 15:
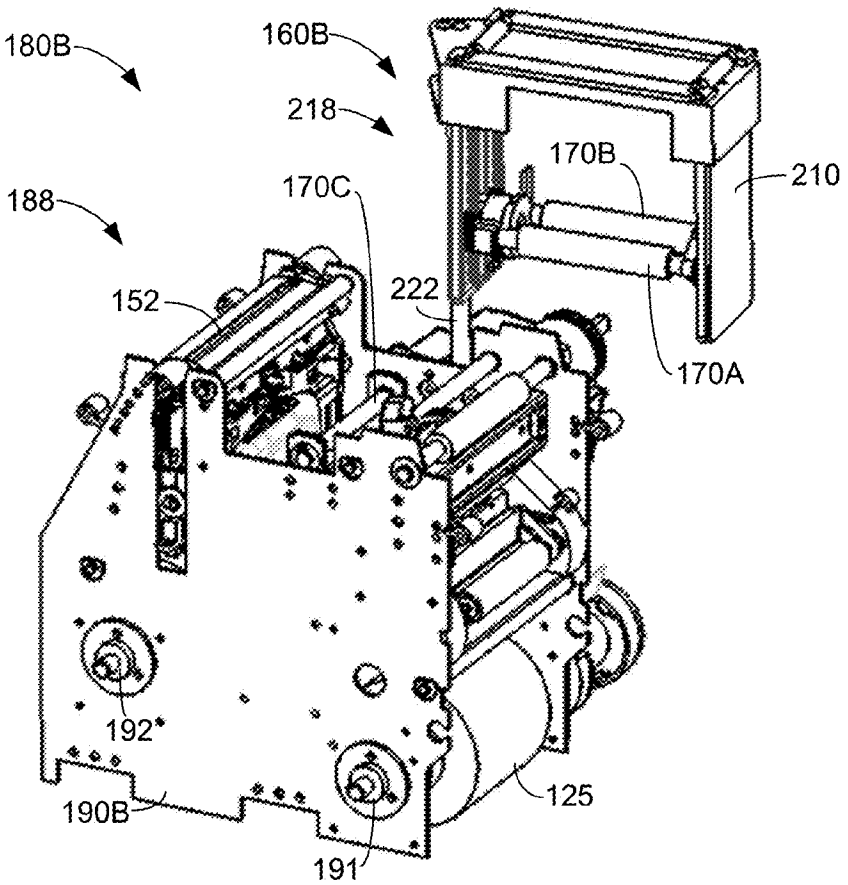
FIGS. 14 and 15 illustrate a processing assembly in a loading position and an exemplary accumulator in an extended position, in accordance with embodiments of the invention.
Figure 14:
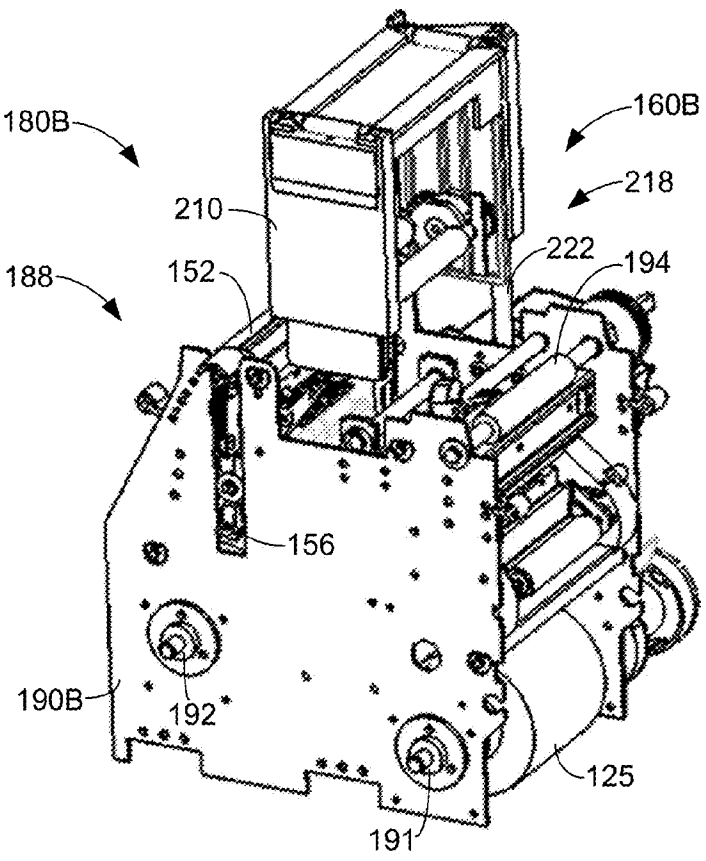
Figure 17:
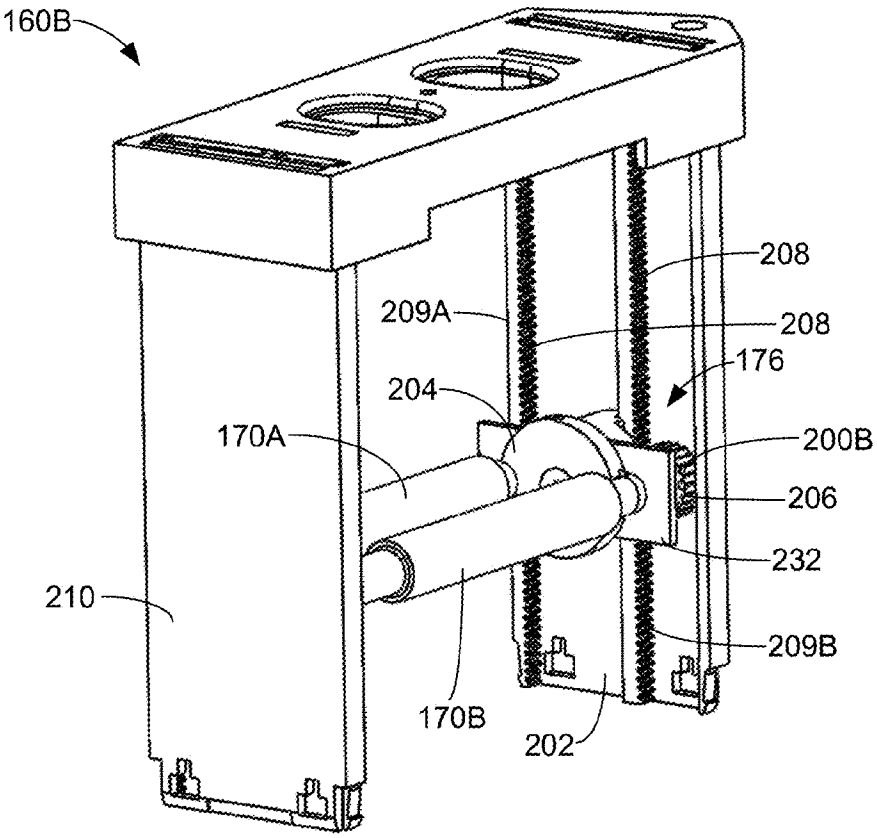
FIGS. 16-18 are isometric views of an exemplary accumulator, or portions thereof, in accordance with embodiments of the invention.
Figure 16:
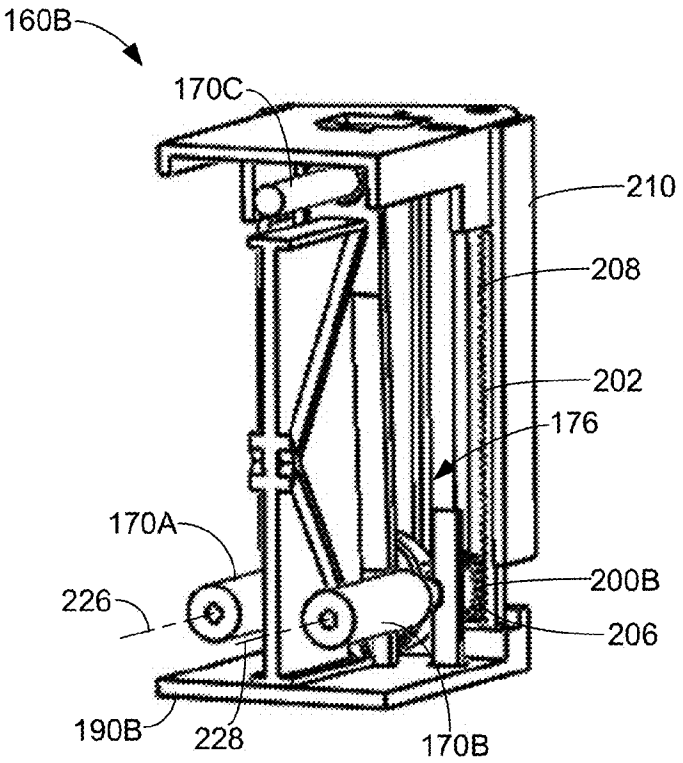
Figure 19:
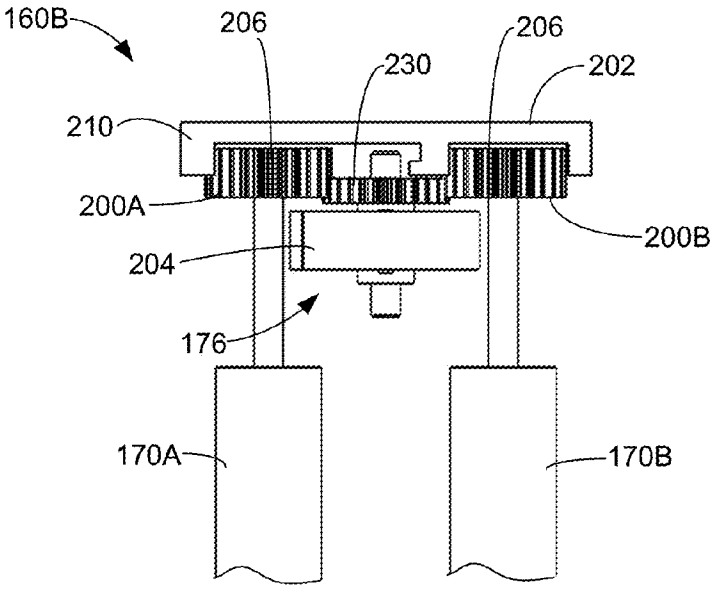
FIG. 19 is a top view of a portion of an exemplary accumulator in accordance with embodiments of the invention.
Figure 18:
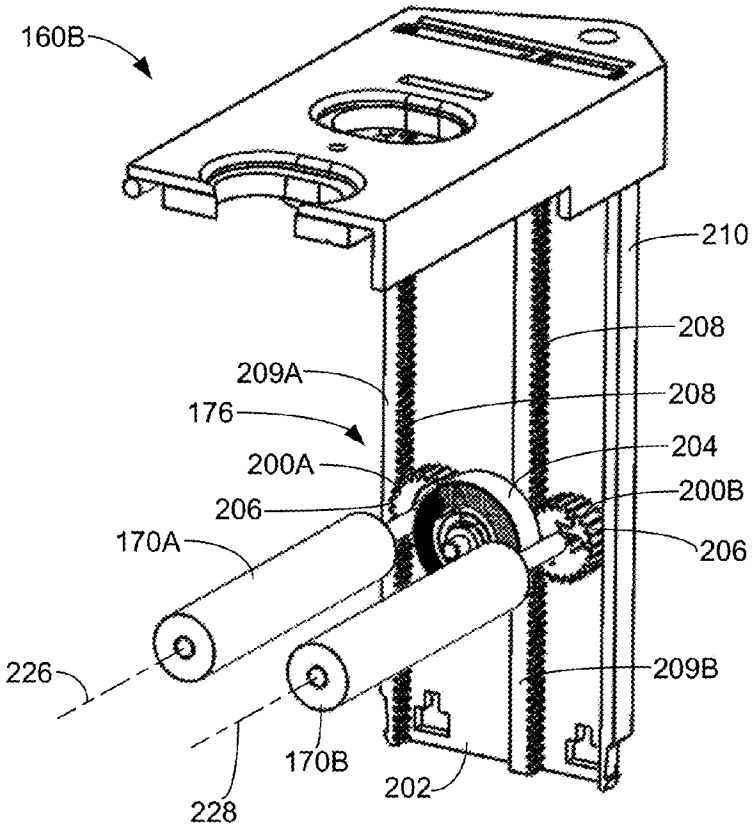

Additional embodiments of the credential production device 100 will be described with reference to FIGS. 11-19. FIG. 11 is a simplified side view of an exemplary credential production device 100B in accordance with embodiments of the invention. FIG. 12 is an isometric view of the device 100B with the processing assemblies 180A and 180B in their operating positions. FIG. 13 is an isometric view of the device 100B with the processing assembly 180B in its loading position 188. FIGS. 14 and 15 illustrate the processing assembly 180B in its loading position 188 and an exemplary accumulator 160 in an extended position, in accordance with embodiments of the invention. FIGS. 16-18 are isometric views of the accumulator 160, or portions thereof, in accordance with embodiments of the invention. FIG. 19 is a top view of a portion of the accumulator 160 in accordance with embodiments of the invention.

In some embodiments, the device 100B includes one or more processing assemblies 180 that are configured to move relative to the main frame 181 and the processing axis 104 in a direction that is transverse or perpendicular to the processing axis 104. In some embodiments, the device 100B includes a processing assembly 180A having a processing assembly frame 190A that supports components of the printing device 122, and/or a processing assembly 180B having a processing assembly frame 190B that supports components of the laminating device 124, as shown in FIG. 11. Thus, components of the printing device 122 move relative to the main frame 181 in response to movement of the processing assembly 180A and its frame 190A between the operating and loading positions 186, 188, and components of the laminating device 124 move relative to the main frame 181 in response to movement of the processing assembly 180A and its frame 190B between the operating and loading positions 186, 188.

In some embodiments, at least one of the processing assemblies 180A or 180B includes or supports the accumulator 160, or components thereof, and the accumulator 160, or components thereof, move relative to the main frame 181 in response to movement of the corresponding processing assembly 180A or 180B between the operating and loading positions 186, 188. While the exemplary embodiments of the device 100B shown in FIG. 11 illustrates the accumulator 160 or components of the accumulator 160 being supported by the processing assembly 180B, it is understood that the accumulator 160 or components of the accumulator 160 may alternatively be supported by the processing assembly 180A.

In some embodiments, the REM's 170A-C and the drive system 176 are each supported by the processing assembly frame 190B of the processing assembly 180B. In some embodiments, the accumulator 160 includes an accumulator frame 210 that moves relative to the processing frame 190B between an operating position 216 (FIGS. 11-13) and an extended position 218 (FIGS. 14 and 15).

In some embodiments, some of the components of the accumulator 160 are attached to the processing frame 190B, while other components of the accumulator 160 are attached to the accumulator frame 210. In some embodiments, the REM's 170C, 170E and 170D are attached to the processing assembly frame 190B, and the REM's 170A and 170B are attached to the accumulator frame 210, as shown in FIGS. 14-18. In some embodiments, the drive system 176 is attached to the accumulator frame 210, as shown in FIGS. 17 and 18. Thus, in some embodiments, the REM's 170A and 170B, and the drive system 176 move relative to the processing assembly frame 190B when the accumulator 160 moves from the operating position 216 to the extended position 218.

The movement of the accumulator 160 from the operating position 216 to the extended position 218 allows the transfer ribbon 120 to be installed on the processing assembly 180B, while the processing assembly 180B is in its loading position 188. In some embodiments, a rod or other suitable guide member 222 facilitates supporting the accumulator frame 210 and its attached components in the extended position 218, as shown in FIGS. 14 and 15. In some embodiments, the guide member 222 allows the accumulator frame 210 to pivot relative to its operating orientation (FIG. 14) to allow for full access to the processing assembly 180B, as shown in FIG. 15. This allows for unencumbered loading of the transfer ribbon 120 on the processing assembly 180B.

In some embodiments, the drive system 176 is configured to drive movement of the REM's 170A and 170B along the axis 174 relative to the accumulator frame 210 and the REM's 170C, 170D and 170E supported by the processing assembly frame 190. In some embodiments, the drive system 176 of the accumulator 160 includes at least one pinion 200, a rack 202, and a drive force mechanism 204. In some embodiments, the at least one pinion 200 includes pinions 200A and 200B (FIG. 16-19), each having external gears 206 that intermesh with gears of 208 of the rack 202 (FIG. 16), such as the gears 208 on the rails 209A and 209B (FIG. 17-18). In some embodiments, the pinion 200A is coupled to the REM 170A and rotates about an axis of rotation 226 (FIG. 16-18) of the REM 170A, and pinion 200B is coupled to the REM 170B and rotates with rotation of the REM 170B about an axis 228 (FIG. 16-18). In some embodiments, the ends of the REM 170A and 170B that are not shown in FIG. 16-18 are also supported by pinions and geared rails, which allows the REM's 170A and 170B to maintain their orientation relative to the accumulator frame 210, as the drive system 176 moves the REM's 170A and 170B relative to the accumulator frame 210.

Embodiments of the drive force mechanism 204 include those described above, such as a spring or motorized mechanism. In some embodiments, the drive force mechanism 204 is coupled to a gear 230, which intermeshes with the pinions 200A and 200B, as shown in FIG. 19. In some embodiments, the drive force mechanism 204 drives rotation of the gear 230, which in turn drives rotation of the pinions 200A and 200B. In some embodiments, a plate 232 (FIG. 17) maintains the relative positions of the REM's 170A and 170B, the pinions 200A and 200B, and the gear 230. The rotation of the pinions 200A and 200B in response to the rotation of the gear 230 drives movement of the REM's 170A and 170B along the axis 174 relative to the accumulator frame 210 and the REM 170C, when the accumulator 160 and the processing assembly 180B are in their operating positions 216 and 186, respectively.

With accumulator frame 210 of the accumulator 160 either removed or moved to the extended position 218, an operator may load the processing assembly 180B with the transfer ribbon 120. As the accumulator 210 and its attached components are then dropped into the processing assembly 180B from the position illustrated in FIG. 14 to the operating position 216 (FIG. 13), the transfer ribbon 120 engages the REM's 170A-E, and the REM's 170A and 170B move relative to the REM's 170C, 170D and 170E along the axis 174 to take up slack in the transfer ribbon 120 and tension the transfer ribbon 120, as discussed above. When the processing assemblies 180A and 180B are moved to their operating positions 186 (FIGS. 11 and 12), the credential production device 100B can begin performing print and lamination operations simultaneously, while the accumulator 160 collects and discharges the transfer ribbon 120 at different rates, as described above.

Although the present invention has been described with reference to preferred embodiments, workers skilled in the art will recognize that changes may be made in form and detail without departing from the spirit and scope of the invention.

COPYRIGHT AND LEGAL NOTICES

A portion of the disclosure of this patent document contains material which is subject to copyright protection in the United States. The copyright owner has no objection to the facsimile reproduction by anyone of the patent document or the patent disclosure, as it appears in the Patent and Trademark Office patent files or records, but otherwise reserves all copyrights whatsoever.

What is claimed is:

1. A credential manufacturing device comprising:
- a transfer ribbon;
- a printing device configured to print an image to the transfer ribbon;
- a laminating device configured to transfer printed images from the transfer ribbon to a substrate; and
- a transfer ribbon accumulator comprising:
  - first and second ribbon-engaging members (REM's) having fixed positions relative to each other and separated by a gap;
  - a third REM configured to move relative to the first and second REM's along an axis that extends through the gap; and
  - a drive system configured to generate a force that drives movement of the third REM relative to the first and second REM's along the axis;
  - wherein movement of the third REM relative to the first and second REM's along the axis changes a length of a path along which a portion of the transfer ribbon travels through the accumulator.

2. The credential manufacturing device according to claim 1, wherein a section of the transfer ribbon extends from the printing device to the laminating device, and the first, second, and third REM's engage a portion of the section of the transfer ribbon.

3. The credential manufacturing device according to claim 2, wherein the first, second, and third REM's are each selected from the group consisting of a roller having an axis of rotation that is perpendicular to the axis, a bar, and a guide member.

4. The credential manufacturing device according to claim 1, wherein the drive system is attached to the first and second REM's.

5. The credential manufacturing device according to claim 1, wherein the drive system is attached to the third REM.

6. The credential manufacturing device according to claim 1, wherein:
- the drive system comprises a pinion, a rack that engages the pinion, and a drive force mechanism that drives rotation of the pinion;
- the rack moves linearly relative to the pinion in response to rotation of the pinion; and
- the third REM moves relative to the first and second REM's in response to rotation of the pinion.

7. The credential manufacturing device according to claim 6, wherein the first and second REM's are coupled to the pinion and move relative to the rack in response to rotation of the pinion.

8. The credential manufacturing device according to claim 7, wherein:
- the pinion comprises a first pinion coupled to the first REM and a second pinion coupled to the second REM; and
- the rack comprises a first rack section engaging the first pinion, and a second rack section engaging the second pinion.

9. The credential manufacturing device according to claim 6, wherein the third REM is coupled to the rack and moves relative to the pinion in response to rotation of the pinion.

10. The credential manufacturing device according to claim 1, wherein the device further comprises:
- a main frame;
- a transport mechanism configured to feed individual substrates along a processing path having a fixed position relative to the main frame; and
- a processing assembly that supports the transfer ribbon, at least a portion of the printing device or the laminating device, and at least a portion of the transfer ribbon accumulator, wherein the transfer assembly is configured to move relative to the main frame and the processing path between operating and loading positions.

11. The credential manufacturing device according to claim 10, wherein:
- at least one of the REM's is supported by the main frame;
- at least one of the REM's is supported by the processing assembly; and
- the processing assembly and the at least one REM supported by the processing assembly move relative to the main frame and the at least one REM supported by the main frame in response to movement of the processing assembly between the operating and loading positions.

12. The credential manufacturing device according to claim 11, wherein the drive system is attached to the main frame.

13. The credential manufacturing device according to claim 11, wherein the drive system is attached to the processing assembly.

14. The credential manufacturing device according to claim 11, wherein the loading position of the processing assembly is displaced from the operating position along a processing axis that is perpendicular to the processing path.

15. The credential manufacturing device according to claim 11, wherein the loading position of the processing assembly is displaced from the operating position along a processing axis that is parallel to the processing path.

16. The credential manufacturing device according to claim 10, wherein:

the processing assembly supports the entire transfer ribbon accumulator;

the processing assembly includes a processing assembly frame;

the accumulator includes an accumulator frame that is removably supported by the processing assembly frame; and the processing assembly and the entire transfer ribbon accumulator move relative to the main frame in response to movement of the processing assembly between the operating and loading positions.

17. The credential manufacturing device according to claim 16, wherein:

at least one of the REM's is supported by the processing assembly frame;

at least one of the REM's is supported by the accumulator frame; and the REM supported by the accumulator frame moves relative to the processing assembly frame and the REM supported by the processing assembly frame in response to movement of the accumulator frame relative to the processing assembly frame.

18. The credential manufacturing device according to claim 17, wherein the drive system is attached to one of the accumulator frame and the processing assembly frame.

19. The credential manufacturing device according claim 16, wherein the loading position of the processing assembly is displaced from the operating position along an axis that is perpendicular to a processing axis, which is parallel to the processing path.

20. The credential manufacturing device according to claim 16, wherein the loading position of the processing assembly is displaced from the operating position along an axis that is parallel to a processing axis, which is parallel to the processing path.

* * * * *